US008998743B2

(12) United States Patent
Nakamura et al.

(10) Patent No.: US 8,998,743 B2
(45) **Date of Patent: *Apr. 7, 2015**

(54) GOLF CLUB

(71) Applicant: Dunlop Sports Co. Ltd., Kobe, Hyogo (JP)

(72) Inventors: Takashi Nakamura, Kobe (JP); Hiroshi Hasegawa, Kobe (JP); Takashi Nakano, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 182 days.

This patent is subject to a terminal disclaimer.

(21) Appl. No.: 13/644,468

(22) Filed: Oct. 4, 2012

(65) Prior Publication Data

US 2013/0095951 A1 Apr. 18, 2013

(30) Foreign Application Priority Data

Oct. 12, 2011 (JP) ..... 2011-224708

(51) Int. Cl.

| | |
|---|---|
| ***A63B 53/10*** | (2006.01) |
| *A63B 53/00* | (2006.01) |
| *A63B 53/04* | (2006.01) |
| *A63B 53/14* | (2006.01) |

(52) U.S. Cl.

CPC ..... *A63B 53/10* (2013.01); *A63B 53/00* (2013.01); *A63B 53/04* (2013.01); *A63B 53/0466* (2013.01); *A63B 53/145* (2013.01); *A63B 2053/0408* (2013.01); *A63B 2209/00* (2013.01); *A63B 2209/023* (2013.01)

(58) Field of Classification Search

USPC ..... 473/292, 316–323

See application file for complete search history.

(56) References Cited

U.S. PATENT DOCUMENTS

| | | | | |
|---|---|---|---|---|
| 5,686,158 | A * | 11/1997 | Gibbon | 428/36.92 |
| 6,306,047 | B1 * | 10/2001 | Kusumoto | 473/319 |
| 6,656,057 | B2 * | 12/2003 | Manual et al. | 473/300 |
| 7,338,386 | B2 * | 3/2008 | Nakajima | 473/319 |
| 7,361,098 | B2 | 4/2008 | Oyama | |
| 7,488,261 | B2 * | 2/2009 | Cackett et al. | 473/300 |
| 7,500,922 | B2 * | 3/2009 | Takeuchi | 473/319 |
| 2009/0069109 | A1 * | 3/2009 | Kumamoto | 473/289 |
| 2010/0041492 | A1 * | 2/2010 | Rice et al. | 473/289 |
| 2010/0144463 | A1 * | 6/2010 | Dawson et al. | 473/345 |
| 2012/0295730 | A1 * | 11/2012 | Hasegawa et al. | 473/292 |
| 2012/0295734 | A1 * | 11/2012 | Hasegawa et al. | 473/319 |

FOREIGN PATENT DOCUMENTS

| | | | |
|---|---|---|---|
| CN | 102784463 | A | 11/2012 |
| JP | 2004-201911 | A | 7/2004 |

* cited by examiner

*Primary Examiner* — Stephen L. Blau

(74) *Attorney, Agent, or Firm* — Birch, Stewart, Kolasch & Birch, LLP

(57) ABSTRACT

Provided is a golf club having a head disposed at a front end of a shaft and a grip disposed at a back end of the shaft. A club weight is not larger than 290 g, and a ratio (head weight/club weight) of a head weight to a club weight is not lower than 0.67 but not higher than 0.72. Furthermore, a grip weight is not smaller than 27 g but not larger than 45 g, and when a distance from the front end of the shaft to a center of gravity the shaft is $L_G$ and when a full length of the shaft is $L_S$, $0.54 \leq L_G/L_S \leq 0.65$ is satisfied.

18 Claims, 8 Drawing Sheets

GOLF CLUB

TECHNICAL FIELD

The present invention relates to a golf club.

BACKGROUND ART

For golfers, flight distance of a ball is one of the important factors when selecting a golf club. Therefore, hitherto, in order to extend the flight distance of the ball, various improvements have been made with regard to shapes and materials of elements forming a golf club.

For example, when the weight of a head is large, kinetic energy provided to a ball when the ball is hit becomes large and the speed of the ball can be increased, and, as a result, a large flight distance can be obtained. Therefore, a technique for increasing a head weight by increasing the proportion of the head weight with respect to the total weight of a golf club has been proposed (e.g., see Patent Literature 1).

CITATION LIST

Patent Literature

[PTL1] Japanese Laid-Open Patent Publication No. 2004-201911

SUMMARY OF INVENTION

Technical Problem

It is possible to increase the kinetic energy provided to a ball by increasing the head weight. However, if only the head weight is increased, the club weight increases, and a powerless golfer is easily overwhelmed in terms of power and cannot increase his/her head speed, and, as a result, cannot increase his/her ball speed.

Therefore, in order to prevent an increase in the club weight, it is conceivable to reduce the weight of components other than the head such as the shaft and the grip. However, in such a case, the center of gravity of the club is brought close to the head side of the club, and thereby an inertia moment at a grip end becomes large. Therefore, also in this case, a powerless golfer is easily overwhelmed in terms of power and cannot increase his/her head speed, and, as a result, cannot increase his/her ball speed.

Furthermore, if the weight of the grip is reduced too much, it becomes difficult to ensure sufficient thickness of the grip, and strength of the grip cannot be obtained.

On the other hand, if only a reduction in the inertia moment at the grip end of the club is considered, it is conceivable to increase the weight of the grip and bring the center of gravity of the club close on the grip side. However, in such a case, the club weight increases, and again, a powerless golfer is easily overwhelmed in terms of power and cannot increase his/her head speed, and, as a result, cannot increase his/her ball speed.

The present invention is made in view of such a situation, and an objective of the present invention is to provide a golf club capable of, in order to increase the ball speed, increasing head speed while having a large weight of the head, and thereby capable of extending a flight distance of a ball.

Solution to Problem (1) A golf club of the present invention is a golf club having a head disposed at a front end of a shaft and a grip disposed at a back end of the shaft, wherein a club weight is not larger than 290 g, a ratio (head weight/club weight) of a head weight to the club weight is not lower than 0.67 but not higher than 0.72, a grip weight is not smaller than 27 g but not larger than 45 g, and when a distance from the front end of the shaft to the center of gravity of the shaft is $L_G$ and when a full length of the shaft is $L_S$, $0.54 \leq L_G/L_S \leq 0.65$ is satisfied.

With the golf club of the present invention, the club weight is reduced to a certain value (290 g) or smaller so as to have a light club weight while increasing the proportion of the head weight with respect to the club weight. Since the club weight is light as 290 g or smaller, even a powerless golfer can easily perform a swing without being overwhelmed in terms of power. As a result, the head speed can be increased, and thereby the ball speed can be increased. In addition, since the proportion of the head weight with respect to the club weight is increased, the kinetic energy of the head can be increased. With this, the kinetic energy provided to a ball when the ball is hit becomes large and the ball speed can be increased.

Furthermore, in the golf club of the present invention, $L_G/L_S$ is set to 0.54 to 0.65, and the center of gravity of the shaft is located on the hand side. Therefore, even when the weight of the head is increased to increase the ball speed, it is possible to prevent the center of gravity of the whole club from moving to the head side, or to allow the center of gravity of the whole club to move to the hand side. With this, it is possible to reduce or prevent an increase of the inertia moment of the club at the grip end, and thereby swinging becomes easy. As a result, it becomes possible to increase the head speed and increase the ball speed, and thereby a flight distance of a ball can be extended.

Furthermore, since the grip weight is not larger than 45 g, it becomes possible to prevent the club weight from being heavy due to the grip weight, and it becomes easy to perform a swing. On the other hand, since the grip weight is not smaller than 27 g, it becomes possible to ensure sufficient thickness for the grip, and durability and cushioning properties of the grip can be obtained.

(2) In the golf club of (1), the shaft weight may be not smaller than 30 g but not larger than 58 g.

(3) In the golf club of (1) or (2), the club weight may be not smaller than 265 g but not larger than 290 g.

(4) In the golf club of (1) to (3), the shaft full length $L_S$ may be not smaller than 105 cm but not larger than 120 cm.

Advantageous Effects of Invention

According to the golf club of the present invention, it becomes possible to, in order to increase a ball speed, increase a head speed while having a large head weight, and thereby a flight distance of a ball can be extended.

DESCRIPTION OF EMBODIMENTS

In the following, embodiments of the golf club of the present invention will be described in detail with reference to the accompanying drawings.

Figure 1:
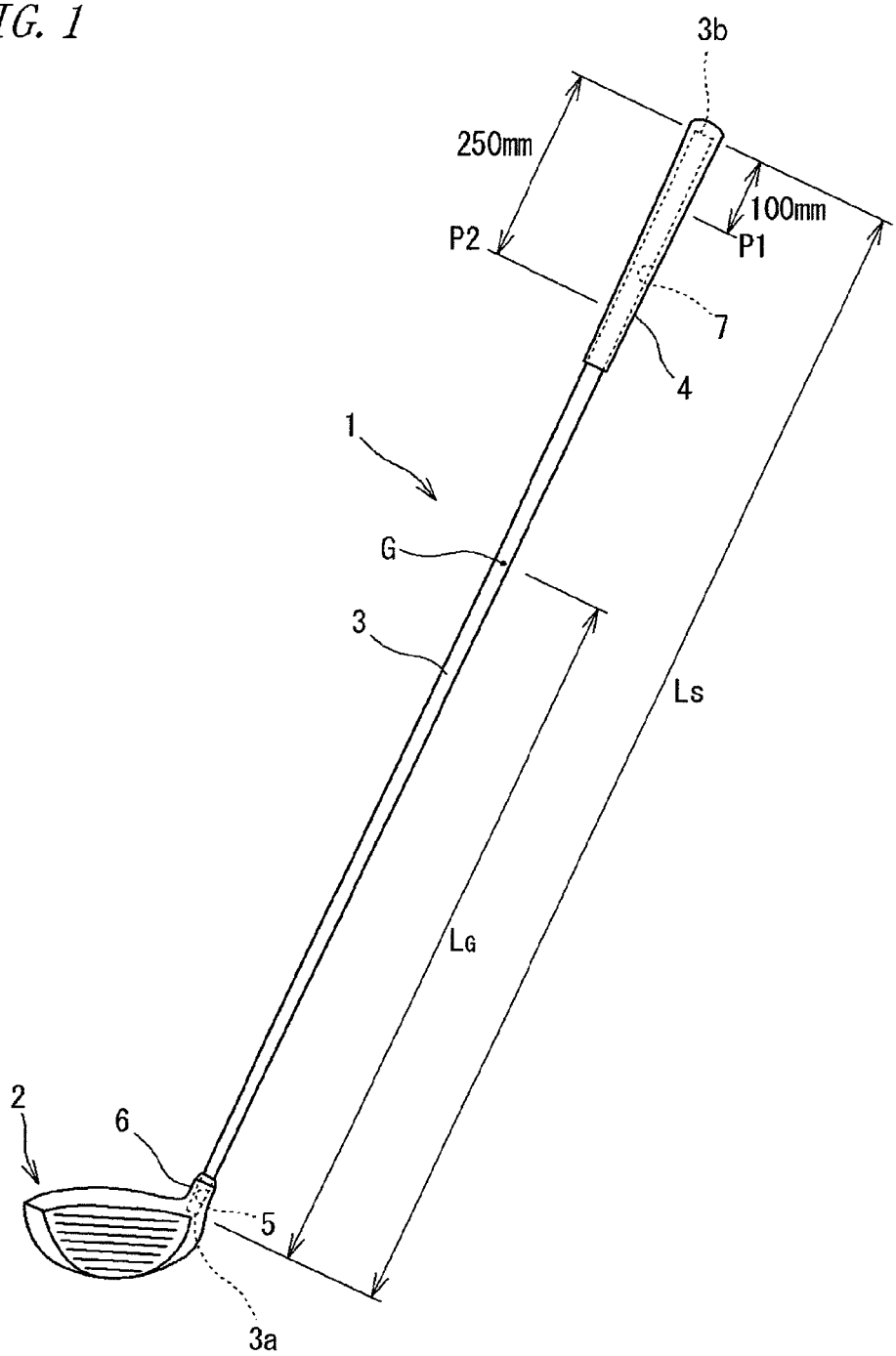
FIG. 1 is an illustrative diagram of one embodiment of a golf club of the present invention.

FIG. 1 is an illustrative diagram showing the entirety of a golf club 1 according to one embodiment of the present invention. The golf club 1 of the present embodiment includes a wood-type golf club head 2 having a predetermined loft angle, a shaft 3, and a grip 4. The head 2 includes a hosel 6 having a shaft hole 5 to which a tip end 3*a* located at the front end side of the shaft 3 is inserted and fixed. A butt end 3*b* at the back end side of the shaft 3 is inserted and fixed in a grip hole 7 of the grip 4. The tip end 3*a* is located inside the head 2, and the butt end 3*b* is located inside the grip 4. It should be noted that, in FIG. 1, a reference character of "G" indicates the center of gravity of the shaft 3. The center of gravity G is located on a shaft axis inside the shaft 3.

In the present invention, the weight of the golf club 1 is set in a range that is not larger than 290 g. If the weight of the golf club 1 is too light, the strengths of respective elements (parts) forming the golf club 1 become low, and durability of the golf club 1 may deteriorate. Therefore, the weight of the golf club 1 is preferably not smaller than 265 g, and further preferably not smaller than 270 g. On the other hand, if the weight of the golf club 1 is too heavy, it becomes difficult to perform a swing, so that it becomes difficult to increase the head speed. Therefore, the weight of the golf club 1 is preferably not larger than 287 g, and further preferably not larger than 284 g.

Further, the length of the golf club 1 itself is not particularly limited in the present invention, and is ordinarily from 42.0 to 46.5 inches. If the length of the golf club 1 is too short, a turning radius of the swing becomes small, so that it becomes difficult to obtain a sufficient head speed. As a result, the ball speed cannot be increased, and the flight distance of the ball cannot be extended. Therefore, the length of the golf club 1 is preferably not smaller than 42.5 inches, and further preferably not smaller than 43.0 inches. On the other hand, if the length of the golf club 1 is too long, the inertia moment at the grip end becomes large, and a powerless golfer can become easily overwhelmed in terms of power. Therefore, the ball speed cannot be increased, and the flight distance of the ball cannot be extended. Thus, the length of the golf club 1 is preferably not larger than 46.3 inches, and further preferably not larger than 46.0 inches.

It should be noted that, in the present specification, "club length" is a length measured based on the description in "Appendix II—Design of Clubs" "1. Clubs" "1c. Length" in the Rules of Golf determined by R&A (The Royal and Ancient Golf Club of Saint Andrews).

[Head Configuration]

The head 2 in the present embodiment is a hollow head and has a large inertia moment. For a club having the head 2 with a large inertia moment, the head 2 is preferably hollow since the advantageous effect of improving flight distance can be stably obtained.

There is no particular limitation in the material of the head 2 in the present invention, and, for example, titanium, titanium alloys, CFRPs (carbon fiber reinforced plastics), stainless steel, maraging steel, soft iron, and the like can be used. Furthermore, instead of manufacturing the head 2 using a single material, the head 2 may be manufactured by combining multiple materials as appropriate. For example, a CFRP and a titanium alloy can be combined together. From a standpoint of lowering the center of gravity of the head 2, it is possible to employ a head in which at least a portion of a crown is made from a CFRP, and at least a portion of a sole is made from a titanium alloy. In addition, from a standpoint of strength, the entirety of a face is preferably made from a titanium alloy.

In the present invention, although the weight of the head 2 itself is not particularly limited, it is preferably within a range from 185 to 210 g. If the head 2 is too light, the kinetic energy of the head 2 cannot be sufficiently provided to the ball, and it becomes difficult to increase the ball speed. Therefore, the weight of the head 2 is further preferably not smaller than 188 g, and particularly preferably not smaller than 192 g. On the other hand, if the weight of the head 2 is too heavy, the golf club 1 becomes heavy and difficult to swing. Therefore, the weight of the head 2 is further preferably not larger than 206 g, and particularly preferably not larger than 203 g.

Furthermore, in the golf club 1 of the present invention, the ratio (head weight/club weight) of the head weight to the club weight is set to be not lower than 0.67 but not higher than 0.72. If this ratio is too small, the kinetic energy of the head 2 becomes small and obtaining a sufficient ball speed becomes difficult. Therefore, the ratio is preferably not lower than 0.675, and further preferably not lower than 0.68. On the other hand, if the ratio is too large, the head 2 becomes too heavy and swinging the club becomes difficult. Therefore, the ratio is preferably not higher than 0.718, and further preferably not higher than 0.715.

[Grip Configuration]

In the present invention, there is no particular limitation in the material and structure of the grip 4, and those commonly used can be adopted as appropriate. For example, there can be used one that is obtained by blending and kneading natural rubber, oil, carbon black, sulfur, and zinc oxide, and molding and vulcanizing the materials into a predetermined shape.

In the present invention, the weight of the grip 4 is set to be not smaller than 27 g but not larger than 45 g. If the weight of the grip 4 is too small, the strength of the grip 4 becomes low, and its durability may deteriorate. Therefore, the weight of the grip 4 is preferably not smaller than 28 g, and further preferably not smaller than 33 g. On the other hand, if the weight of the grip 4 is too large, the golf club 1 becomes heavy and difficult to swing. Therefore, the weight of the grip 4 is preferably not larger than 44 g, and further preferably not larger than 40 g.

[Shaft Configuration]

The shaft 3 in the present embodiment is a carbon shaft, and is manufactured through an ordinarily sheet winding process using a prepreg sheet as a material. In more detail, the shaft 3 is a tubular body formed from a laminated body of a fiber reinforced resin layer, and has a hollow structure. The full length of the shaft 3 is represented as $L_S$, and the distance from the tip end (front end) 3*a* of the shaft 3 to the center of gravity G of the shaft 3 is represented as $L_G$.

Although the weight of the shaft 3 is not particularly limited in the present invention, it is ordinarily within a range from 30 to 58 g. If the weight of the shaft 3 is too small, the strength of the shaft 3 becomes low, and its durability may deteriorate. Therefore, the weight of the shaft 3 is preferably not smaller than 34 g, and further preferably not smaller than 38 g. On the other hand, if the weight of the shaft 3 is too large, the golf club 1 becomes heavy and difficult to swing. Therefore, the weight of the shaft 3 is preferably not larger than 53 g, and further preferably not larger than 50 g.

Further, although the length of the shaft 3 itself is not particularly limited in the present invention, it is ordinarily from 1050 to 1200 mm. If the length of the shaft 3 is too short, a turning radius of the swing becomes small, so that it becomes difficult to obtain a sufficient head speed. As a result, the ball speed cannot be increased, and the flight distance of the ball cannot be extended. Therefore, the length of the shaft 3 is preferably not smaller than 1070 mm, and further preferably not smaller than 1100 mm. On the other hand, if the length of the shaft 3 is too long, the inertia moment at the grip end becomes large, and a powerless golfer can become easily overwhelmed in terms of power. Therefore, the head speed cannot be increased, and the flight distance of the ball cannot be extended. Thus, the length of the shaft 3 is preferably not larger than 1180 mm, and further preferably not larger than 1160 mm.

Furthermore, although the position of the center of gravity itself of the shaft 3 is not particularly limited in the present invention, it is ordinarily located within a range of 620 to 710 mm from the tip end 3*a* (front end) of the shaft 3. If the center of gravity G of the shaft 3 is located closer than 620 mm from the front end of the shaft 3, the center of gravity is brought close to the head side of the golf club 1, and swinging and obtaining a sufficient head speed become difficult. Therefore, the position of the center of gravity of the shaft 3 is preferably, when measured from the front end of the shaft 3, not closer than 625 mm and further preferably not closer than 630 mm. On the other hand, if the position of the center of gravity G of the shaft 3 is farther than 710 mm from the front end of the shaft 3, the strength on the front end side of the shaft becomes low, and its durability deteriorates. Therefore, the position of the center of gravity of the shaft 3 is preferably, when measured from the front end of the shaft 3, not farther than 705 mm and further preferably not farther than 700 mm.

In the present invention, when the distance from the front end of the shaft 3 to the center of gravity G of the shaft is represented as $L_G$ and when the full length of the shaft 3 is represented as $L_S$, $0.54 \leq L_G/L_S \leq 0.65$ is satisfied.

If $L_G/L_S$ is lower than 0.54, since the center of gravity of the shaft 3 is located close to the front end side of the shaft 3, the weight of the head cannot be increased when swing balance is taken into consideration. Therefore, $L_G/L_S$ is preferably not lower than 0.55, and further preferably not lower than 0.56.

On the other hand, if $L_G/L_S$ is higher than 0.65, the weight on the hand side of the shaft becomes large and the weight on the front end side of the shaft becomes small when the weight of the shaft is unchanged. As a result, the strength on the front end side of the shaft may become weak. Furthermore, to increase the ratio higher than 0.65 while preventing deterioration of the strength on the front end side of the shaft means to increase the weight on the hand side while maintaining the weight on the front end side of the shaft; and this causes the full weight of the club to be too large and swinging the club becomes difficult. Therefore, $L_G/L_S$ is preferably not higher than 0.64, and further preferably not higher than 0.63.

The shaft 3 can be manufactured by curing a prepreg sheet, and fibers in this prepreg sheet are orientated substantially in one direction. A prepreg whose fibers are orientated substantially in one direction is also referred to as a UD (Uni-Direction) prepreg. It should be noted that, in the present invention, prepregs other than a UD prepreg can also be used, and, for example, a prepreg sheet in which fibers included in the sheet are knitted can also be used.

The prepreg sheet includes a matrix resin formed from a thermosetting resin and the like, and a fiber such as a carbon fiber. As described above, although the shaft 3 can be manufactured through a sheet winding process, the matrix resin is in a semi-cured state in a prepreg form. The shaft 3 is obtained by winding and curing the prepreg. The curing of the prepreg is conducted by applying heat, and steps for manufacturing the shaft 3 include a heating step. The matrix resin in the prepreg sheet is cured in this heating step.

The matrix resin of the prepreg sheet is also not particularly limited in the present invention, and, for example, thermoplastic resins and thermosetting resins such as epoxy resins can be used. From a standpoint of enhancing the strength of the shaft, an epoxy resin is preferably used.

As the prepreg, a commercially available product can be used as appropriate, and the following Table 1-1 and Table 1-2 shows examples of prepregs that can be used as the shaft of the golf club of the present invention.

TABLE 1-1

Example of Usable Prepreg

| Manufacturer Name | Prepreg Sheet Stock Number | Sheet Thickness (mm) | Fiber Content (Mass %) | Resin Content (Mass %) |
|---|---|---|---|---|
| Toray Industries, Inc. | 3255S-10 | 0.082 | 76 | 24 |
| Toray Industries, Inc. | 3255S-12 | 0.103 | 76 | 24 |
| Toray Industries, Inc. | 3255S-15 | 0.123 | 76 | 24 |
| Toray Industries, Inc. | 805S-3 | 0.034 | 60 | 40 |
| Toray Industries, Inc. | 2255S-10 | 0.082 | 76 | 24 |
| Toray Industries, Inc. | 2255S-12 | 0.102 | 76 | 24 |
| Toray Industries, Inc. | 2255S-15 | 0.123 | 76 | 24 |
| Toray Industries, Inc. | 2256S-10 | 0.077 | 80 | 20 |
| Toray Industries, Inc. | 2256S-12 | 0.103 | 80 | 20 |
| Toray Industries, Inc. | 9255S-8 | 0.061 | 76 | 24 |
| Nippon Graphite Fiber Corp. | E1026A-09N | 0.100 | 63 | 37 |
| Nippon Graphite Fiber Corp. | E1026A-14N | 0.150 | 63 | 37 |
| Mitsubishi Rayon Co., Ltd. | TR350C-100S | 0.083 | 75 | 25 |
| Mitsubishi Rayon Co., Ltd. | TR350C-125S | 0.104 | 75 | 25 |
| Mitsubishi Rayon Co., Ltd. | TR350C-150S | 0.124 | 75 | 25 |
| Mitsubishi Rayon Co., Ltd. | TR350C-175S | 0.146 | 75 | 25 |
| Mitsubishi Rayon Co., Ltd. | MR350C-075S | 0.063 | 75 | 25 |
| Mitsubishi Rayon Co., Ltd. | MR350C-100S | 0.085 | 75 | 25 |
| Mitsubishi Rayon Co., Ltd. | MR350C-125S | 0.105 | 75 | 25 |
| Mitsubishi Rayon Co., Ltd. | MR350E-100S | 0.093 | 70 | 30 |
| Mitsubishi Rayon Co., Ltd. | HRX350C-075S | 0.057 | 75 | 25 |
| Mitsubishi Rayon Co., Ltd. | HRX350C-110S | 0.082 | 75 | 25 |

TABLE 1-2

| Example of Usable Prepreg | | | | |
|---|---|---|---|---|
| | | Carbon Fiber Physical Property Value | | |
| Manufacturer Name | Prepreg Sheet Stock Number | Carbon Fiber Stock Number | Tensile Elastic Modulus* ($t/mm^2$) | Tensile Strength* ($kgf/mm^2$) |
| Toray Industries, Inc. | 3255S-10 | T700S | 23.5 | 500 |
| Toray Industries, Inc. | 3255S-12 | T700S | 23.5 | 500 |
| Toray Industries, Inc. | 3255S-15 | T700S | 23.5 | 500 |
| Toray Industries, Inc. | 805S-3 | M30S | 30 | 560 |
| Toray Industries, Inc. | 2255S-10 | T800S | 30 | 600 |
| Toray Industries, Inc. | 2255S-12 | T800S | 30 | 600 |
| Toray Industries, Inc. | 2255S-15 | T800S | 30 | 600 |
| Toray Industries, Inc. | 2256S-10 | T800S | 30 | 600 |
| Toray Industries, Inc. | 2256S-12 | T800S | 30 | 600 |
| Toray Industries, Inc. | 9255S-8 | M40S | 40 | 470 |
| Nippon Graphite Fiber Corp. | E1026A-09N | XN-10 | 10 | 190 |
| Nippon Graphite Fiber Corp. | E1026A-14N | XN-10 | 10 | 190 |
| Mitsubishi Rayon Co., Ltd. | TR350C-100S | TR50S | 24 | 500 |
| Mitsubishi Rayon Co., Ltd. | TR350C-125S | TR50S | 24 | 500 |
| Mitsubishi Rayon Co., Ltd. | TR350C-150S | TR50S | 24 | 500 |
| Mitsubishi Rayon Co., Ltd. | TR350C-175S | TR50S | 24 | 500 |
| Mitsubishi Rayon Co., Ltd. | MR350C-075S | MR40 | 30 | 450 |
| Mitsubishi Rayon Co., Ltd. | MR350C-100S | MR40 | 30 | 450 |
| Mitsubishi Rayon Co., Ltd. | MR350C-125S | MR40 | 30 | 450 |
| Mitsubishi Rayon Co., Ltd. | MR350E-100S | MR40 | 30 | 450 |
| Mitsubishi Rayon Co., Ltd. | HRX350C-075S | HR40 | 40 | 450 |
| Mitsubishi Rayon Co., Ltd. | HRX350C-110S | HR40 | 40 | 450 |

*Tensile strength and tensile elastic modulus are values measured in accordance with "Carbon fiber testing method" of JIS R7601:1986.

Figure 2:
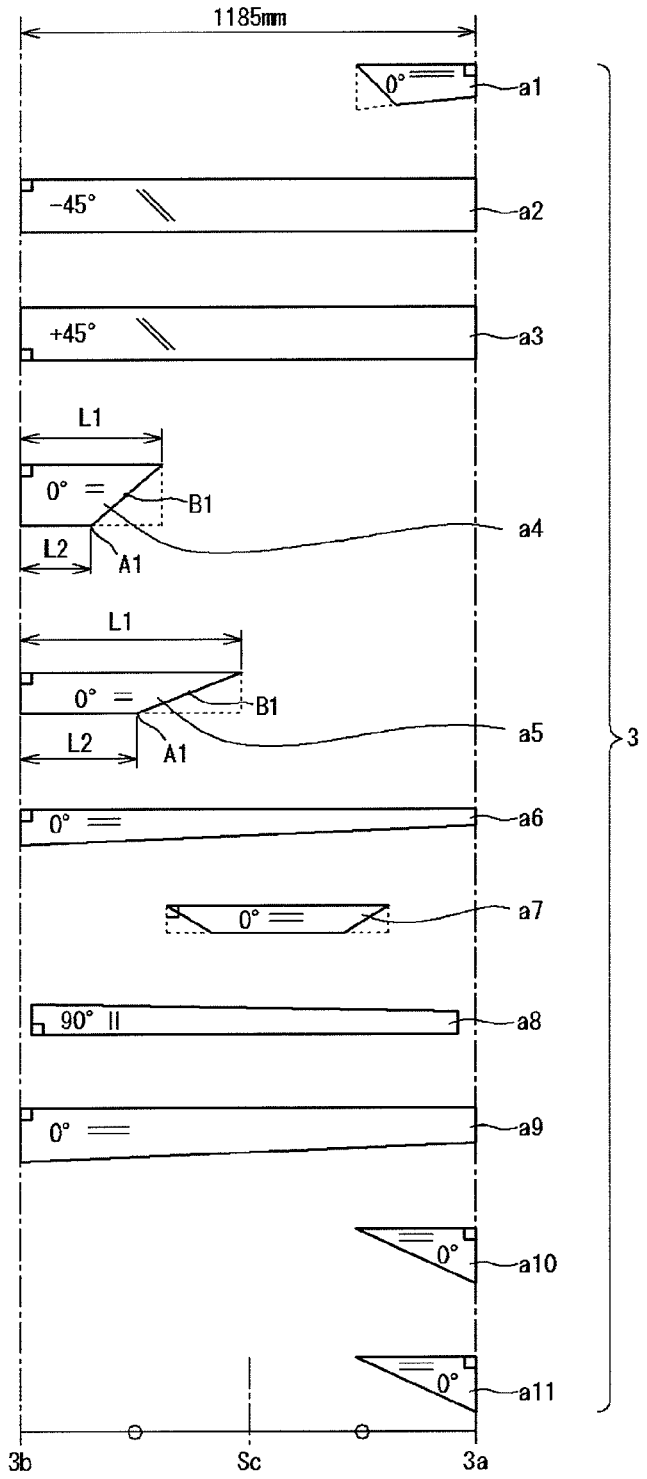
FIG. 2 is an expansion plan of a prepreg sheet included in a shaft of the golf club shown in FIG. 1.

FIG. 2 is an expansion plan (sheet block diagram) of the prepreg sheet forming the shaft 3. The shaft 3 includes multiple sheets, and in the embodiment shown in FIG. 2, the shaft 3 includes eleven sheets of a1 to a11. The expansion plan shown in FIG. 2 shows the sheets forming the shaft, sequentially from the inner side of a radial direction of the shaft. In the expansion plan, winding is conducted sequentially from a sheet located on the upper side. Further, in the expansion plan shown in FIG. 2, the right-left direction in the drawing coincides with the axial direction of the shaft, the right side in the drawing is the tip end 3*a* side of the shaft 3, and the left side in the drawing is the butt end 3*b* side of the shaft 3.

It should be noted that, in the present specification, a term "layer" and a term "sheet" are used. The "sheet" is a designation for those prior to being wound, and the "layer" is a designation for the sheets after being wound. The "layer" is formed by winding the "sheet." Furthermore, in the present specification, the same reference character is used for a layer and a sheet. For example, a layer formed by winding the sheet a1 is described as a layer a1.

Furthermore, in the present specification, regarding the angle of a fiber with respect to the axial direction of the shaft, an angle Af and an absolute angle θa are used. The angle Af is an angle that is associated with a plus or a minus, and the absolute angle θa is an absolute value of the angle Af. The absolute angle θa is an absolute value of an angle between the axial direction of the shaft and a fiber direction. For example, "the absolute angle θa being equal to or smaller than 10°" means "the angle Af being not smaller than −10° but not larger than +10°".

The expansion plan shown in FIG. 2 not only shows a winding sequence of each of the sheets, but also shows a position of each of the sheets in the axial direction of the shaft. For example, the end of the sheet a1 is located at the tip end 3*a*, and the ends of the sheet a4 and the sheet a5 are located at the butt end 3*b*.

The shaft 3 includes straight layers, bias layers, and a hoop layer. The expansion plan shown in FIG. 2 describes an orientation angle of a fiber included in the prepreg sheet; and a sheet having a description of "0°" forms a straight layer. A sheet for the straight layer is also referred to as a straight sheet in the present specification. In addition, a sheet for the bias layer is also referred to as a bias sheet in the present specification.

The straight layer is a layer whose fiber orientation is substantially 0° with respect to a longitudinal direction of the shaft (axial direction of the shaft). However, there are cases where the direction of the fiber is not perfectly 0° with respect to the axial direction of the shaft, due to errors at the time of winding. Ordinarily, in the straight layer, the absolute angle θa is equal to or smaller than 10°.

In the embodiment shown in FIG. 2, the straight sheets are the sheet a1, the sheet a4, the sheet a5, the sheet a6, the sheet a7, the sheet a9, the sheet a10, and the sheet a11. The straight layer is highly correlated with flexural rigidity and flexural strength of the shaft.

The bias layer is a layer whose fiber orientation is slanted with respect to the longitudinal direction of the shaft. The bias layer is highly correlated with twist rigidity and twist strength of the shaft. The bias layer is preferably formed from a pair of two sheets whose fiber orientations are slanted in directions opposite to each other. From a standpoint of twist rigidity, the absolute angle θa of the bias layer is preferably equal to or larger than 15°, more preferably equal to or larger than 25°, and further preferably equal to or larger than 40°. On the other hand, from the standpoint of twist rigidity and twist strength, the absolute angle θa of the bias layer is preferably equal to or smaller than 60°, and more preferably equal to or smaller than 50°.

In the embodiment shown in FIG. 2, the bias sheets are the sheet a2 and the sheet a3. In FIG. 2, the angle Af is described for all of the sheets. Plus (+) and minus (−) of the angles Af indicate that fibers of the bias sheets are slanted in directions opposite to each other. It should be noted that, in the embodiment shown in FIG. 2, although the angle Af of the sheet a2 is −45° and the angle Af of the sheet a3 is +45°, contrary to that, the angle Af of the sheet a2 may be +45° and the angle Af of the sheet a3 may be −45°.

In the embodiment shown in FIG. 2, the sheet forming the hoop layer is the sheet a8. The absolute angle θa of the hoop layer is preferably substantially 90° with respect to the axial direction of the shaft. However, there are cases where the direction of the fiber is not perfectly 90° with respect to the axial direction of the shaft, due to errors at the time of winding. Ordinarily, in the hoop layer, the absolute angle θa is not smaller than 80° but not larger than 90°.

The hoop layer contributes to enhancing crush rigidity and crush strength of the shaft. The crush rigidity is rigidity against crushing force toward the inner side of the radial direction of the shaft. The crush strength is strength against crushing force toward the inner side of the radial direction of the shaft. The crush strength is also related to flexural strength. Furthermore, crush deformation may occur associated with flexural deformation. This association is particularly large for a thin lightweight shaft. By improving the crush strength, flexural strength can be improved.

Although not diagrammatically represented, the prepreg sheet before it is being used is sandwiched between cover sheets. Ordinarily, a cover sheet consists of a release paper and a resin film, and the release paper is pasted on one surface of the prepreg sheet, and the resin film is pasted on the other surface. In the following description, the surface on which the release paper is pasted is also referred to as "release paper side surface" and the surface on which the resin film is pasted is also referred to as "film side surface."

The expansion plans in the present specification are diagrams in which the film side surface is on the front side. In other words, in the expansion plans in the present specification, the front side in the drawing is the film side surface, and the reverse side in the drawing is the release paper side surface. In the expansion plan shown in FIG. 2, the fiber direction of the sheet a2 and the fiber direction of the sheet a3 are identical, whereas when being attached as described later, the sheet a3 will be turned over. As a result, the fiber direction of the sheet a2 and the fiber direction of the sheet a3 become directions opposite to each other, and thereby, in a state after the winding, the fiber direction of the sheet a2 and the fiber direction of the sheet a3 will be directions opposite to each other. This point is taken into consideration, and in FIG. 2, the fiber direction of the sheet a2 is denoted as "−45°" and the fiber direction of the sheet a3 is denoted as "+45°."

In order to wind the above described prepreg sheet, firstly, the resin film is peeled. By peeling the resin film, the film side surface becomes exposed. This exposed surface has tackiness (adhesiveness) originating from the matrix resin. Since the matrix resin of the prepreg at the time of the winding is in a semi-cured state, the matrix resin expresses adhesiveness. Next, a margin part (wind-start margin part) on the exposed surface of the film side is attached to a to-be-wound object. Attaching to the wind-start margin part can be smoothly conducted due to the adhesiveness of the matrix resin. The to-be-wound object is a mandrel, or a wound object obtained by winding another prepreg sheet on a mandrel.

Next, the release paper of the prepreg sheet is peeled. Then, the to-be-wound object is rotated to wind the prepreg sheet on the to-be-wound object. In the manner described above, first, the resin film is peeled; next, the wind-start margin part is attached to the to-be-wound object, and then, the release paper is peeled. With such a procedure, occurrences of wrinkling of the prepreg sheet and inferior winding can be prevented. The release paper has high flexural rigidity when compared to the resin film, and a sheet having such release paper attached thereto is supported by the release paper and is unlikely to wrinkle.

Figure 3:
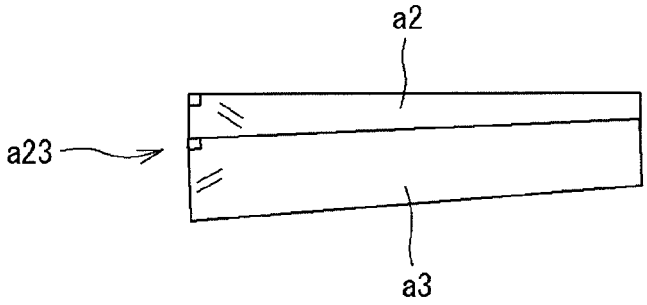
FIG. 3 is a plan view of a first merged sheet in the shaft shown in FIG. 2.
Figure 4:
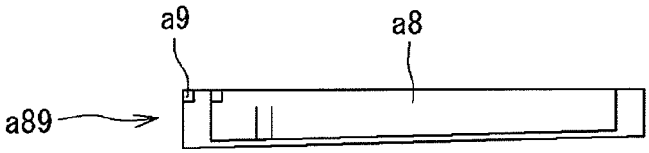
FIG. 4 is a plan view of a second merged sheet in the shaft shown in FIG. 2.

In the embodiment shown in FIG. 2, a merged sheet formed by attaching two or more sheets together is employed. For the embodiment shown in FIG. 2, two merged sheets shown in FIGS. 3 and 4 are employed. FIG. 3 shows a first merged sheet a23 formed by attaching the sheet a2 and the sheet a3 together. In addition, FIG. 4 shows a second merged sheet a89 formed by attaching the sheet a8 and the sheet a9 together.

The procedure for manufacturing the first merged sheet a23 will be described below. First, the bias sheet a3 is turned over, and the turned over bias sheet a3 is attached to the bias sheet a2. At that time, as shown in FIG. 3, a butt end and a tip end of the bias sheet a3 are each attached to the bias sheet a2 so as to be misaligned from a long side of the bias sheet a2.

As a result, the sheet a2 and the sheet a3 of the merged sheet a23 are misaligned from each other by about half a wind in the shaft after the winding.

As shown in FIG. 4, in the second merged sheet a89, the upper end of the sheet a8 matches the upper end of the sheet a9. Additionally, in the sheet a89, the entirety of the sheet a8 is pasted on the sheet a9 in a state where a butt side end margin of the sheet a8 is misaligned from a butt side end margin of the sheet a9. As a result, inferior winding of the sheet a8 in the winding step is prevented.

As described above, in the present specification, although the sheets and layers are classified by their fiber's orientation angle in the prepreg, the sheets and layers can be further classified by their length in the axial direction of the shaft.

In the present specification, a layer arranged over the whole axial direction of the shaft is referred to as a full length layer, and a sheet arranged over the whole axial direction of the shaft is referred to as a full length sheet. On the other hand, in the present specification, a layer partially arranged in the axial direction of the shaft is referred to as a partial layer, and a sheet partially arranged in the axial direction of the shaft is referred to as a partial sheet.

In the present specification, a straight layer that is a full length layer is referred to as a full length straight layer. In the embodiment shown in FIG. 2, the sheet a6 and the sheet a9 form the full length straight layers after the winding.

In addition, in the present specification, a straight layer that is a partial layer is referred to as a partial straight layer. In the embodiment shown in FIG. 2, the sheet a1, the sheet a4, the sheet a5, the sheet a7, the sheet a10, and the sheet a11 form the partial straight layers after the winding.

After the winding, the sheet a7, which is a sheet included in the partial layers, form a middle partial layer located in the middle of the whole axial direction of the shaft. Thus, a front end of the middle partial layer is separated from the tip end 3*a*, and a back end of the middle partial layer is separated from the butt end 3*b*. Preferably, the middle partial layer is arranged at a position including a center position Sc of the axial direction of the shaft. Furthermore, preferably, the middle partial layer is arranged at a position including a B point (a point located 525 mm away from the tip end) defined by a method for measuring three point flexural strength (a measuring method for SG-type three point flexural strength testing). The middle partial layer can selectively reinforce a portion that has large deformation, and can also contribute to weight reduction of the shaft.

In the present specification, a term "butt partial layer" is used. The butt partial layer is one mode of the partial layer, and is a partial layer that is located on the butt end 3*b* side. Shown in FIG. 2 with a reference character of "A1" is a point located on the most butt side on a side of the butt partial layer in the tip side. Preferably, the point A1 is located closer to the butt side than the center position Sc of the axial direction of the shaft. Shown in FIG. 2 with a reference character of "B1" is a middle point of a side of the butt partial layer in the tip side. Preferably, the point B1 is located closer to the butt side than the center position Sc of the axial direction of the shaft. The butt partial layer includes a butt straight layer, a butt hoop layer, and a butt bias layer.

In addition, in the present specification, a term "butt straight layer" is used. The butt straight layer is one mode of the partial straight layer, and is a partial straight layer located on the butt end 3*b* side. Preferably, the entirety of the butt straight layer is located closer to the butt side than the center position Sc of the axial direction of the shaft. The back end of the butt straight layer may or may not be located at the butt end 3*b* of the shaft. From a standpoint of bringing the position of the center of gravity of the club close to the butt end 3*b*, preferably, an arrangement range of the butt straight layer includes a position P1 that is separated from the butt end 3*b* of the shaft by 100 mm. From a standpoint of bringing the position of the center of gravity of the club close to the butt end 3*b*, more preferably, the back end of the butt straight layer is located at the butt end 3*b* of the shaft. In the embodiment shown in FIG. 2, the butt straight layer is the sheet a4 and the sheet a5.

The shaft 3 is manufactured through a sheet winding process using the prepreg sheet shown in FIG. 2. In the following, a general outline of the steps for manufacturing the shaft 3 will be described.

[General Outline of Shaft Manufacturing Steps]

(1) Cutting Step

In a cutting step, the prepreg sheet is cut into predetermined shapes, and each of the sheets shown in FIG. 2 is cut out.

(2) Attaching Step

In an attaching step, multiple sheets are attached together to manufacture the merged sheet a23 and the merged sheet a89 described above. For the attaching, applying of heat or pressing can be used; however, from a standpoint of reducing misalignments between sheets forming a merged sheet in a later described winding step and improving accuracy of the winding, the applying of heat and the pressing are preferably used in combination. Although heating temperature and pressing pressure can be selected as appropriate from a standpoint of enhancing the adhesive strength among the sheets, the heating temperature is ordinarily within a range from 30 to 60° C., and the pressing pressure is ordinarily within a range from 300 to 600 g/cm$^2$. Similarly, although heating time and pressing time can also be selected as appropriate from a standpoint of enhancing the adhesive strength among the sheets, the heating time is ordinarily within a range from 20 to 300 seconds, and the pressing time is ordinarily within a range from 20 to 300 seconds.

(3) Winding Step

In the winding step, a mandrel is used. A representative mandrel is made from metal, and a mold releasing agent is applied on a circumferential surface of the mandrel. Additionally, a resin (tacking resin) having adhesiveness is applied over the mold releasing agent. The cut sheets are wound on the mandrel which has the resin applied thereon. As a result of the tacking resin, an end part of the sheet can be attached easily to the mandrel. A sheet obtained by attaching multiple sheets together is wound in a state of a merged sheet.

With this winding step, a wound body can be obtained. The wound body is obtained by winding a prepreg sheet on the outer side of the mandrel. The winding is conducted, for example, by rolling a to-be-wound object on a flat surface.

(4) Tape Wrapping Step

In a tape wrapping step, a tape referred to as a wrapping tape is wound on an outer circumferential surface of the wound body. The wrapping tape is wound on the outer circumferential surface of the wound body while being kept in tension. With the wrapping tape, pressure is applied to the wound body and void in the wound body is reduced.

(5) Curing Step

In a curing step, the wound body which has been wrapped with the tape is heated at a predetermined temperature. As a result of the heating, the matrix resin in the prepreg sheet is cured. In the curing process, the matrix resin temporarily fluidizes, and through this fluidization, air within or between the sheets is discharged. The discharging of air is enhanced by the pressure (fastening force) provided by the wrapping tape. With the curing step, a cured lamination body is obtained.

(6) Mandrel Draw-Out Step and Wrapping Tape Removal Step

After the curing step, a mandrel draw-out step and a wrapping tape removal step are conducted. Although there is no particular limitation in the sequence of the two steps in the present invention, from a standpoint of improving efficiency of the wrapping tape removal, the wrapping tape removal step is preferably conducted after the mandrel draw-out step.

(7) Both-Ends Cutting Step

In a both-ends cutting step, both ends of the cured lamination body obtained through each of the steps of (1) to (6) described above are cut. As a result of the cutting, the end surface of the tip end 3*a* and the end surface of the butt end 3*b* of the shaft become smooth.

(8) Polishing Step

In a polishing step, the surface of the cured lamination body whose both ends are cut is polished. Helical concavities and convexities remain on the surface of the cured lamination body as traces of the wrapping tape used in step (4) described above. As a result of the polishing, the helical concavities and convexities which are traces of the wrapping tape disappear, and the surface of the cured lamination body becomes smooth.

(9) Painting Step

A prescribed paint is applied on the cured lamination body after the polishing step.

With the above described steps, the shaft 3 can be manufactured. The golf club 1 can be obtained by fixing the tip end 3*a* of the manufactured shaft 3 in the shaft hole 5 of the hosel 6 of the golf club head 2, and fixing the butt end 3*b* of the shaft 3 in the grip hole 7 of the grip 4.

One feature of the present invention is that, in the golf club 1 described above, when the distance from the front end 3*a* of the shaft 3 to the center of gravity of the shaft is represented as $L_G$ and when the full length of the shaft is represented as $L_S$, $0.54 \leq L_G/L_S \leq 0.65$ is satisfied and the center of gravity G of the shaft 3 is brought close to the hand side.

Reducing club weight is effective in making the club easy to swing. However, the weight of the head which is one element forming the club is a factor that influences an increase in ball speed. Therefore, in the present invention, an approach of increasing the ball speed without reducing the head weight is adopted. By placing the position of the center of gravity of the shaft on the grip side, the inertia moment of the club is reduced to make the club easy to swing.

Means for adjusting the position of the center of gravity of the shaft 3 includes, for example, the following (A) to (H). In the present invention, it is possible to bring the position of the center of gravity of the shaft 3 close to the hand side by employing one or more of these means as appropriate.

(A) Increasing or decreasing the number of windings of the butt partial layer (B) Increasing or decreasing the thickness of the butt partial layer (C) Increasing or decreasing a length L1 (described later) of the butt partial layer (D) Increasing or decreasing a length L2 (described later) of the butt partial layer (E) Increasing or decreasing the number of windings of the tip partial layer (F) Increasing or decreasing the thickness of the tip partial layer (G) Increasing or decreasing a shaft-direction length of the tip partial layer (H) Increasing or decreasing a taper rate of the shaft <Weight Ratio of Butt Partial Layer>

From a standpoint of placing the position of the center of gravity of the shaft on the grip side, the weight of the butt partial layer with respect to the shaft weight is preferably not smaller than 5 wt %, and more preferably not smaller than 10 wt %. On the other hand, from a standpoint of reducing a stiff feeling, the weight of the butt partial layer with respect to the shaft weight is preferably not larger than 50 wt %, and more preferably not larger than 45 wt %. In the embodiment shown in FIG. 2, a total weight of the sheet a4 and the sheet a5 is the weight of the butt partial layer.

<Weight Ratio of Butt Partial Layer in Specific Butt Range>

Indicated as "P2" in FIG. 1 is a point separated from the butt end 3*b* by 250 mm. A range from point P2 to the butt end 3*b* is defined as a "specific butt range." When the weight of the butt partial layer existing in the specific butt range is represented as "Wa," and when the weight of the shaft in the specific butt range is represented as "Wb," from a standpoint of placing the position of the center of gravity of the shaft on the grip side, the ratio (Wa/Wb) is preferably not lower than 0.4, more preferably not lower than 0.42, and further preferably not lower than 0.44. On the other hand, from a standpoint of reducing a stiff feeling, the ratio (Wa/Wb) is preferably not higher than 0.7, more preferably not higher than 0.65, and further preferably not higher than 0.6.

<Fiber Elastic Modulus of Butt Partial Layer>

From a standpoint of ensuring strength of the butt partial layer, the fiber elastic modulus of the butt partial layer is preferably not lower than 5 t/mm$^2$, and more preferably not lower than 7 t/mm$^2$. When the center of gravity of the club is close to the butt end 3*b*, centrifugal force that acts upon the center of gravity of the club easily decreases. In other words, when the center-of-gravity position of the shaft is placed on the grip side, the centrifugal force that acts upon the center of gravity of the club easily decreases. In such a case, it becomes difficult to sense the bending of the shaft, and a stiff feeling is easily generated. From a standpoint of reducing a stiff feeling, the fiber elastic modulus of the butt partial layer is preferably not higher than 20 t/mm$^2$, more preferably not higher than 15 t/mm$^2$, and further preferably not higher than 10 t/mm$^2$.

<Resin Content of Butt Partial Layer>

From a standpoint of placing the center-of-gravity position of the shaft on the grip side and reducing a stiff feeling, the resin content of the butt partial layer is preferably not lower than 20 mass %, and more preferably not lower than 25 mass %. On the other hand, from a standpoint of ensuring strength of the butt partial layer, the resin content of the butt partial layer is preferably not higher than 50 mass %, and more preferably not higher than 45 mass %.

<Weight of Butt Straight Layer>

From a standpoint of placing the position of the center of gravity of the shaft on the grip side, the weight of the butt straight layer is preferably not smaller than 2 g, and more preferably not smaller than 4 g. On the other hand, from a standpoint of reducing a stiff feeling, the weight of the butt straight layer is preferably not larger than 30 g, more preferably not larger than 20 g, and further preferably not larger than 10 g.

<Weight Ratio of Butt Straight Layer>

From a standpoint of placing the position of the center of gravity of the shaft on the grip side, the weight of the butt straight layer with respect to the shaft weight Ws is preferably not smaller than 5 mass %, and more preferably not smaller than 10 mass %. On the other hand, from a standpoint of reducing a stiff feeling, the weight of the butt straight layer with respect to the shaft weight is preferably not larger than 50 mass %, and more preferably not larger than 45 mass %. In the embodiment shown in FIG. 3, the total weight of the sheet a4 and the sheet a5 is the weight of the butt straight layer.

<Fiber Elastic Modulus of Butt Straight Layer>

From a standpoint of ensuring strength of the butt part, the fiber elastic modulus of the butt straight layer is preferably not lower than 5 t/mm$^2$, and more preferably not lower than 7 t/mm$^2$. On the other hand, from a standpoint of reducing a stiff feeling, the fiber elastic modulus of the butt straight layer is preferably not higher than 20 t/mm$^2$, more preferably not higher than 15 t/mm$^2$, and further preferably not higher than 10 t/mm$^2$.

<Resin Content of Butt Straight Layer>

From a standpoint of placing the position of the center of gravity of the shaft on the grip side, and reducing a stiff feeling, the resin content of the butt straight layer is preferably not lower than 20 mass %, and more preferably not lower than 25 mass %. On the other hand, from a standpoint of ensuring strength of the butt part, the resin content of the butt straight layer is preferably not higher than 50 mass %, and more preferably not higher than 45 mass %.

<Maximum Shaft Direction Length L1 of Butt Partial Layer>

Shown as "L1" in FIG. 2 is the maximum shaft direction length of the butt partial layer. The maximum length L1 is determined in each butt partial sheet. In the embodiment shown in FIG. 2, a length L1 of the sheet a4 is different from a length L1 of the sheet a5.

From a standpoint of ensuring weight of the butt partial layer, the length L1 is preferably not smaller than 100 mm, more preferably not smaller than 125 mm, and further preferably not smaller than 150 mm. On the other hand, from a standpoint of placing the position of the center of gravity of the shaft on the grip side, the length L1 is preferably not larger than 700 mm, more preferably not larger than 650 mm, and further preferably not larger than 600 mm.

<Minimum Shaft Direction Length L2 of Butt Partial Layer>

Shown as "L2" in FIG. 2 is the minimum shaft direction length of the butt partial layer. The minimum length L2 is determined in each butt partial sheet. In the embodiment shown in FIG. 2, a length L2 of the sheet a4 is different from a length L2 of the sheet a5.

From a standpoint of ensuring weight of the butt partial layer, the length L2 is preferably not smaller than 50 mm, more preferably not smaller than 75 mm, and further preferably not smaller than 100 mm. On the other hand, from a standpoint of placing the position of the center of gravity of the shaft on the grip side, the length L2 is preferably not larger than 650 mm, more preferably not larger than 600 mm, and further preferably not larger than 550 mm.

[Examples]

Next, the golf club of the present invention will be described based on Examples; however, the present invention is not limited only to those Examples.

Golf clubs according to Examples 1 to 21 and Comparative Examples 1 to 31 were manufactured in accordance with a hitherto known method, and their performances and characteristics were evaluated. A substantially identical shaped head was used for all the golf clubs, and the volume of the head was 460 cc, and the material of the head was a titanium alloy. Head weights, grip weights, shaft weights, shaft lengths etc., were adjusted so as to obtain desired specifications.

Shafts for the Examples and Comparative Examples were manufactured based on the expansion plan shown in FIG. 2. The used manufacturing method was similar to that used for the shaft 3 described above, and the shafts were manufactured in accordance with the steps of (1) to (9). For each of the sheets a1 to a11, the number of windings, the thickness of the prepreg, the fiber content of the prepreg, and the tensile elastic modulus of carbon fiber etc., were selected as appropriate. Examples of the prepregs used for the shafts in the Examples and Comparative Examples are shown in Table 2. For adjusting the position of the center of gravity of the shafts, one or more of the above described (A) to (H) were used.

TABLE 2

Specification of Prepreg Sheet

| Reference Character of Cut Sheet | Manufacturer Name | Prepreg Sheet Stock Number | Sheet Thickness (mm) | Fiber Content (Mass %) | Resin Content (Mass %) | Carbon Fiber Physical Property Value: Carbon Fiber Stock Number | Carbon Fiber Physical Property Value: Tensile Elastic Modulus ($t/mm^2$) | Carbon Fiber Physical Property Value: Tensile Strength ($kgf/mm^2$) |
|---|---|---|---|---|---|---|---|---|
| a1 | Nippon Graphite Fiber Corp. | E1026A-14N | 0.15 | 63 | 37 | XN-10 | 10 | 190 |
| a2, a3 | Toray Industries, Inc. | 9255S-8 | 0.061 | 76 | 24 | M40S | 40 | 470 |
| a4 | Nippon Graphite Fiber Corp. | E1026A-09N | 0.1 | 63 | 37 | XN-10 | 10 | 190 |
| a5 | Mitsubishi Rayon Co., Ltd. | MR350C-125S | 0.104 | 75 | 25 | TR50S | 24 | 500 |
| a6, a7, a10, a11 | Mitsubishi Rayon Co., Ltd. | TR350C-100S | 0.083 | 75 | 25 | TR50S | 24 | 500 |
| a8 | Toray Industries, Inc. | 805S-3 | 0.0342 | 60 | 40 | M30S | 30 | 560 |
| a9 | Mitsubishi Rayon Co., Ltd. | TR350C-175S | 0.146 | 75 | 25 | TR50S | 24 | 500 |

Specifications and evaluations of the golf clubs according to Examples 1 to 7 and Comparative Examples 1 to 6 (the club weights are set to 275 g) are shown in Table 3. In addition, specifications and evaluations of the golf clubs according to Examples 8 to 14 and Comparative Examples 7 to 12 (the club weights are set to 282 g) are shown in Table 4. Further, specifications and evaluations of the golf clubs according to Examples 15 to 21 and Comparative Examples 13 to 18 (the club weights are set at 289 g) are shown in Table 5. Still further, specifications and evaluations of the golf clubs according to Comparative Examples 19 to 31 (club weights are set to 292 g) are shown in Table 6. It should be noted that, in Tables 3 to 6, the standard for measuring "center of gravity of club" is the grip end, and distances (mm) from the grip end to the center of gravity of the club are the values in "center of gravity of club" in the Tables.

TABLE 3

Specifications and Evaluation Results of Examples and Comparative Examples (Club Weight: 275 g)

| | Change Head Weight/Club Weight | | | | | Change Grip Weight | |
|---|---|---|---|---|---|---|---|
| | Comp. Ex. 1 | Ex. 1 | Ex. 2 | Ex. 3 | Comp. Ex. 2 | Comp. Ex. 3 | Ex. 4 |
| Club Weight [g] | 275 | 275 | 275 | 275 | 275 | 275 | 275 |
| Head Weight/Club Weight | 0.66 | 0.68 | 0.695 | 0.71 | 0.73 | 0.695 | 0.695 |
| Grip Weight [g] | 37.5 | 37.5 | 37.5 | 37.5 | 37.5 | 26 | 28 |
| $L_G/Ls$ | 0.6 | 0.6 | 0.6 | 0.6 | 0.6 | 0.6 | 0.6 |
| Club Length [inch] | 45.5 | 45.5 | 45.5 | 45.5 | 45.5 | 45.5 | 45.5 |
| Center of Gravity of Club [mm] | 857.4 | 875.7 | 889.4 | 903.2 | 921.5 | 900.9 | 898.6 |
| Shaft Weight [g] | 54 | 48.5 | 44.375 | 40.25 | 34.75 | 55.875 | 53.875 |
| Shaft Length [mm] | 1150 | 1150 | 1150 | 1150 | 1150 | 1150 | 1150 |
| Head Speed [m/s] | 40.8 | 40.7 | 40.5 | 40.2 | 39.9 | 40.3 | 40.4 |
| Kinetic Energy [J] | 151.1 | 154.9 | 156.7 | 157.8 | 159.8 | 155.2 | 156.0 |
| Ball Flight Distance [yards] | 195 | 200 | 202 | 204 | 206 | 200 | 201 |
| Inertia Moment at Grip End [$kg \cdot cm^2$] | 2570 | 2660 | 2720 | 2790 | 2890 | 2780 | 2770 |
| Grip Durability | A | A | A | A | A | D | B |
| Shaft Durability | A | A | A | A | B | A | A |

| | Change Grip Weight | | Change $L_G/Ls$ | | | |
|---|---|---|---|---|---|---|
| | Ex. 5 | Comp. Ex. 4 | Comp. Ex. 5 | Ex. 6 | Ex. 7 | Comp. Ex. 6 |
| Club Weight [g] | 275 | 275 | 275 | 275 | 275 | 275 |
| Head Weight/Club Weight | 0.695 | 0.695 | 0.695 | 0.695 | 0.695 | 0.695 |
| Grip Weight [g] | 44 | 47 | 37.5 | 37.5 | 37.5 | 37.5 |
| $L_G/Ls$ | 0.6 | 0.6 | 0.52 | 0.55 | 0.64 | 0.67 |
| Club Length [inch] | 45.5 | 45.5 | 45.5 | 45.5 | 45.5 | 45.5 |
| Center of Gravity of Club [mm] | 884.9 | 880.3 | 910.1 | 900.9 | 880.3 | 871.1 |
| Shaft Weight [g] | 37.875 | 34.875 | 44.375 | 44.375 | 44.375 | 44.375 |
| Shaft Length [mm] | 1150 | 1150 | 1150 | 1150 | 1150 | 1150 |
| Head Speed [m/s] | 40.5 | 40.6 | 40.0 | 40.3 | 40.6 | 40.8 |
| Kinetic Energy [J] | 156.7 | 157.5 | 152.9 | 155.2 | 157.5 | 159.1 |
| Ball Flight Distance [yards] | 202 | 203 | 197 | 200 | 203 | 205 |

TABLE 3-continued

| Specifications and Evaluation Results of Examples and Comparative Examples (Club Weight: 275 g) | | | | | | |
|---|---|---|---|---|---|---|
| Inertia Moment at Grip End [kg · cm$^2$] | 2700 | 2680 | 2830 | 2780 | 2680 | 2640 |
| Grip Durability | A | A | A | A | A | A |
| Shaft Durability | A | B | A | A | A | B |

TABLE 4

| Specifications and Evaluation Results of Examples and Comparative Examples (Club Weight: 282 g) | | | | | | | |
|---|---|---|---|---|---|---|---|
| | Change Head Weight /Club Weight | | | | | Change Grip Weight | |
| | Comp. Ex. 7 | Ex. 8 | Ex. 9 | Ex. 10 | Comp. Ex. 8 | Comp. Ex. 9 | Ex. 11 |
| Club Weight [g] | 282 | 282 | 282 | 282 | 282 | 282 | 282 |
| Head Weight/Club Weight | 0.66 | 0.68 | 0.695 | 0.71 | 0.73 | 0.695 | 0.695 |
| Grip Weight [g] | 37.5 | 37.5 | 37.5 | 37.5 | 37.5 | 26 | 28 |
| $L_G$/Ls | 0.6 | 0.6 | 0.6 | 0.6 | 0.6 | 0.6 | 0.6 |
| Club Length [inch] | 45.5 | 45.5 | 45.5 | 45.5 | 45.5 | 45.5 | 45.5 |
| Center of Gravity of Club [mm] | 865.6 | 881.2 | 896.8 | 912.5 | 930.2 | 908 | 905.8 |
| Shaft Weight [g] | 55.38 | 49.74 | 45.51 | 41.28 | 35.64 | 57.01 | 55.01 |
| Shaft Length [mm] | 1150 | 1150 | 1150 | 1150 | 1150 | 1150 | 1150 |
| Head Speed [m/s] | 40.5 | 40.3 | 40.0 | 39.7 | 39.3 | 40.0 | 40.0 |
| Kinetic Energy [J] | 152.7 | 155.4 | 156.8 | 157.8 | 159.2 | 157.1 | 157.0 |
| Ball Flight Distance [yards] | 197 | 201 | 202 | 204 | 205 | 203 | 203 |
| Inertia Moment at Grip End [kg · cm$^2$] | 2660 | 2730 | 2800 | 2880 | 2990 | 2790 | 2790 |
| Grip Durability | A | A | A | A | A | D | B |
| Shaft Durability | A | A | A | A | B | A | A |

| | Change Grip Weight | | Change $L_G$/Ls | | | |
|---|---|---|---|---|---|---|
| | Ex. 12 | Comp. Ex. 10 | Comp. Ex. 11 | Ex. 13 | Ex. 14 | Comp. Ex. 12 |
| Club Weight [g] | 282 | 282 | 282 | 282 | 282 | 282 |
| Head Weight/Club Weight | 0.695 | 0.695 | 0.695 | 0.695 | 0.695 | 0.695 |
| Grip Weight [g] | 44 | 47 | 37.5 | 37.5 | 37.5 | 37.5 |
| $L_G$/Ls | 0.6 | 0.6 | 0.52 | 0.55 | 0.64 | 0.67 |
| Club Length [inch] | 45.5 | 45.5 | 45.5 | 45.5 | 45.5 | 45.5 |
| Center of Gravity of Club [mm] | 892.4 | 887.9 | 939.3 | 923.6 | 876.7 | 861.1 |
| Shaft Weight [g] | 39.01 | 36.01 | 45.51 | 45.51 | 45.51 | 45.51 |
| Shaft Length [mm] | 1150 | 1150 | 1150 | 1150 | 1150 | 1150 |
| Head Speed [m/s] | 39.9 | 40.0 | 39.3 | 39.7 | 40.3 | 40.6 |
| Kinetic Energy [J] | 156.4 | 156.5 | 151.2 | 154.7 | 159.3 | 161.2 |
| Ball Flight Distance [yards] | 202 | 202 | 195 | 200 | 205 | 208 |
| Inertia Moment at Grip End [kg · cm$^2$] | 2820 | 2810 | 3000 | 2880 | 2710 | 2640 |
| Grip Durability | A | A | A | A | A | A |
| Shaft Durability | A | B | A | A | A | B |

TABLE 5

| Specifications and Evaluation Results of Examples and Comparative Examples (Club Weight: 289 g) | | | | | | | |
|---|---|---|---|---|---|---|---|
| | Change Head Weight/Club Weight | | | | | Change Grip Weight | |
| | Comp. Ex. 13 | Ex. 15 | Ex. 16 | Ex. 17 | Comp. Ex. 14 | Comp. Ex. 15 | Ex. 18 |
| Club Weight [g] | 289 | 289 | 289 | 289 | 289 | 289 | 289 |
| Head Weight/Club Weight | 0.66 | 0.68 | 0.695 | 0.71 | 0.73 | 0.695 | 0.695 |
| Grip Weight [g] | 37.5 | 37.5 | 37.5 | 37.5 | 37.5 | 26 | 28 |
| $L_G$/Ls | 0.6 | 0.6 | 0.6 | 0.6 | 0.6 | 0.6 | 0.6 |

TABLE 5-continued

| Specifications and Evaluation Results of Examples and Comparative Examples (Club Weight: 289 g) | | | | | | | |
|---|---|---|---|---|---|---|---|
| Club Length [inch] | 45.5 | 45.5 | 45.5 | 45.5 | 45.5 | 45.5 | 45.5 |
| Center of Gravity of Club [mm] | 868.6 | 886 | 899.1 | 914.4 | 929.6 | 910 | 905.7 |
| Shaft Weight [g] | 57.76 | 51.98 | 47.645 | 43.31 | 37.53 | 59.145 | 57.145 |
| Shaft Length [mm] | 1150 | 1150 | 1150 | 1150 | 1150 | 1150 | 1150 |
| Head Speed [m/s] | 40.1 | 40.0 | 39.7 | 39.5 | 39.2 | 39.8 | 39.8 |
| Kinetic Energy [J] | 153.7 | 156.8 | 158.5 | 159.8 | 162.2 | 158.8 | 159.1 |
| Ball Flight Distance [yards] | 198 | 202 | 204 | 206 | 209 | 205 | 205 |
| Inertia Moment at Grip End [kg · cm$^2$] | 2760 | 2810 | 2880 | 2950 | 3020 | 2870 | 2860 |
| Grip Durability | A | A | A | A | A | D | B |
| Shaft Durability | A | A | A | A | B | A | A |

| | Change Grip Weight | | Change $L_G$/Ls | | | |
|---|---|---|---|---|---|---|
| | Ex. 19 | Comp. Ex. 16 | Comp. Ex. 17 | Ex. 20 | Ex. 21 | Comp. Ex. 18 |
| Club Weight [g] | 289 | 289 | 289 | 289 | 289 | 289 |
| Head Weight/Club Weight | 0.695 | 0.695 | 0.695 | 0.695 | 0.695 | 0.695 |
| Grip Weight [g] | 44 | 47 | 37.5 | 37.5 | 37.5 | 37.5 |
| $L_G$/Ls | 0.6 | 0.6 | 0.52 | 0.55 | 0.64 | 0.67 |
| Club Length [inch] | 45.5 | 45.5 | 45.5 | 45.5 | 45.5 | 45.5 |
| Center of Gravity of Club [mm] | 892.6 | 890.4 | 940.5 | 923.1 | 879.5 | 864.2 |
| Shaft Weight [g] | 41.145 | 38.145 | 47.645 | 47.645 | 47.645 | 47.645 |
| Shaft Length [mm] | 1150 | 1150 | 1150 | 1150 | 1150 | 1150 |
| Head Speed [m/s] | 39.7 | 39.7 | 39.0 | 39.4 | 40.1 | 40.3 |
| Kinetic Energy [J] | 158.4 | 158.2 | 152.7 | 155.8 | 161.1 | 163.0 |
| Ball Flight Distance [yards] | 204 | 204 | 195 | 201 | 208 | 210 |
| Inertia Moment at Grip End [kg · cm$^2$] | 2880 | 2890 | 3080 | 2970 | 2790 | 2720 |
| Grip Durability | A | A | A | A | A | A |
| Shaft Durability | A | B | A | A | A | B |

TABLE 6

| Specifications and Evaluation Results of Comparative Examples (Club Weight: 292 g) | | | | | | | |
|---|---|---|---|---|---|---|---|
| | Change Head Weight/Club Weight | | | | | Change Grip Weight | |
| | Comp. Ex. 19 | Comp. Ex. 20 | Comp. Ex. 21 | Comp. Ex. 22 | Comp. Ex. 23 | Comp. Ex. 24 | Comp. Ex. 25 |
| Club Weight [g] | 292 | 292 | 292 | 292 | 292 | 292 | 292 |
| Head Weight/Club Weight | 0.66 | 0.68 | 0.695 | 0.71 | 0.73 | 0.695 | 0.695 |
| Grip Weight [g] | 37.5 | 37.5 | 37.5 | 37.5 | 37.5 | 26 | 28 |
| $L_G$/Ls | 0.6 | 0.6 | 0.6 | 0.6 | 0.6 | 0.6 | 0.6 |
| Club Length [inch] | 45.5 | 45.5 | 45.5 | 45.5 | 45.5 | 45.5 | 45.5 |
| Center of Gravity of Club [mm] | 869.8 | 887.1 | 900.1 | 915.2 | 932.4 | 910.8 | 908.7 |
| Shaft Weight [g] | 58.78 | 52.94 | 48.56 | 44.18 | 38.34 | 60.06 | 58.06 |
| Shaft Length [mm] | 1150 | 1150 | 1150 | 1150 | 1150 | 1150 | 1150 |
| Head Speed [m/s] | 39.4 | 39.3 | 39.1 | 38.8 | 38.5 | 39.1 | 39.1 |
| Kinetic Energy [J] | 149.7 | 153.1 | 155.0 | 155.9 | 158.1 | 155.3 | 155.2 |
| Ball Flight Distance [yards] | 192 | 196 | 198 | 198 | 201 | 199 | 199 |
| Inertia Moment at Grip End [kg · cm$^2$] | 2810 | 2860 | 2910 | 2990 | 3070 | 2900 | 2900 |
| Grip Durability | A | A | A | A | B | D | C |
| Shaft Durability | A | A | A | A | B | A | A |

| | Change Grip Weight | | Change $L_G$/Ls | | | |
|---|---|---|---|---|---|---|
| | Comp. Ex. 26 | Comp. Ex. 27 | Comp. Ex. 28 | Comp. Ex. 29 | Comp. Ex. 30 | Comp. Ex. 31 |
| Club Weight [g] | 292 | 292 | 292 | 292 | 292 | 292 |
| Head Weight/Club Weight | 0.695 | 0.695 | 0.695 | 0.695 | 0.695 | 0.695 |
| Grip Weight [g] | 44 | 47 | 37.5 | 37.5 | 37.5 | 37.5 |
| $L_G$/Ls | 0.6 | 0.6 | 0.52 | 0.55 | 0.64 | 0.67 |
| Club Length [inch] | 45.5 | 45.5 | 45.5 | 45.5 | 45.5 | 45.5 |
| Center of Gravity of Club [mm] | 893.6 | 891.4 | 938.9 | 923.8 | 880.6 | 865.5 |

TABLE 6-continued

| Specifications and Evaluation Results of Comparative Examples (Club Weight: 292 g) | | | | | | |
|---|---|---|---|---|---|---|
| Shaft Weight [g] | 42.06 | 39.06 | 48.56 | 48.56 | 48.56 | 48.56 |
| Shaft Length [mm] | 1150 | 1150 | 1150 | 1150 | 1150 | 1150 |
| Head Speed [m/s] | 39.1 | 39.0 | 38.4 | 38.8 | 39.4 | 39.6 |
| Kinetic Energy [J] | 154.8 | 154.7 | 149.5 | 152.8 | 157.5 | 159.5 |
| Ball Flight Distance [yards] | 198 | 198 | 191 | 196 | 202 | 204 |
| Inertia Moment at Grip End [kg · cm$^2$] | 2910 | 2920 | 3100 | 2980 | 2820 | 2750 |
| Grip Durability | A | A | A | A | A | A |
| Shaft Durability | B | B | A | A | B | B |

[Evaluation Method]

<Head Speed (m/s)>

Five testers having handicaps of 10 to 20 were asked to each test-hit 10 balls, and an average value of the obtained 50 head speeds was used.

<Kinetic Energy (J)>

Kinetic energy was calculated using $E=(mh\times v^2)/2$. Here, mh is head weight and v is head speed.

<Ball Flight Distance (Yards)>

Five testers having handicaps of 10 to 20 were asked to each test-hit 10 balls, and an average value (an average value of flight distances of 8×5=40 shots) of flight distances to drop points of balls for the best 8 shots excluding miss-shots was used.

<Inertia Moment (kg·cm$^2$) at Grip End>

Figure 5:
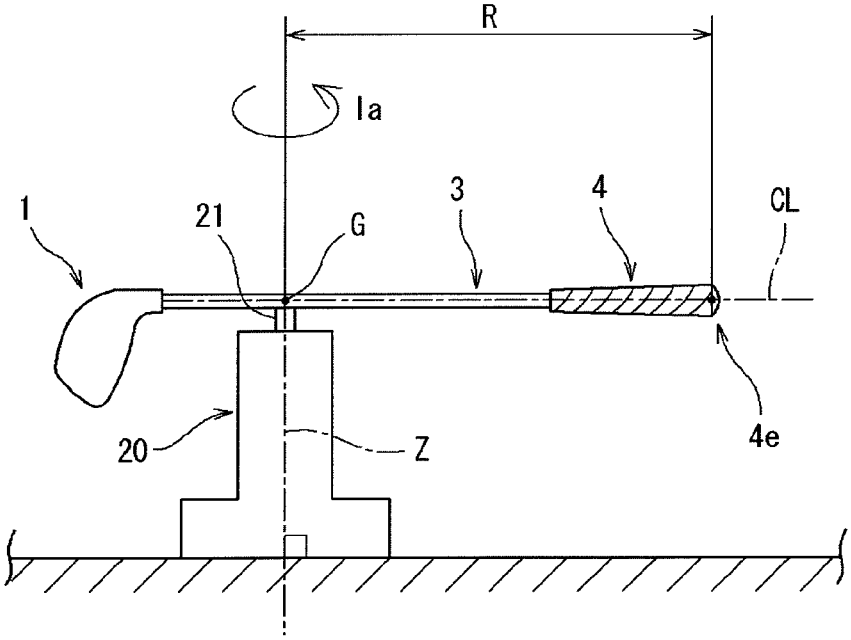
FIG. 5 is a diagram for describing a method for measuring inertia moment at a grip end.

As shown in FIG. 5, the golf club 1 was balanced and placed on a measuring jig 21 of an inertia moment measuring instrument 20 (model number RIK/005-002; manufactured by Inertia Dynamics, LLC) such that a shaft center line CL of the shaft 3 becomes horizontal. At that moment, the center of gravity G of the golf club 1 is positioned on the measuring jig 21. Then, an inertia moment Ia about the center of gravity G ("Z" represents a rotation axis) of the golf club 1 was measured. An inertia moment $I_G$ at a back end 4*e* of the grip was obtained by the following formula using the parallel axis theorem.

$$I_G(kg\cdot cm^2)=Ia+m\cdot R^2$$

Here, "m" represents the weight (kg) of the golf club, "R" represents a shaft direction distance (cm) from the back end 4*e* of the grip to the center of gravity G of the golf club 1, and "Ia" represents the inertia moment (kg·cm$^2$) about the center of gravity G of the golf club 1.

<Grip Durability>

Five testers capable of obtaining a head speed of 40 to 45 m/s conducted an actual hitting test. An average of shot numbers at which a tear, abrasion, etc., occurred in the grip was examined, and evaluation was conducted in accordance with the following standards.

D: Damaged less than 3000 shots were hit

C: Damaged not less than 3000 shots but less than 5000 shots were hit

B: Damaged not less than 5000 shots but less than 10000 shots were hit

A: No damage when 10000 shots were hit

<Shaft Durability>

The golf clubs were mounted on a swing robot manufactured by Miyamae K.K., and golf balls were repeatedly hit at a head speed of 52 m/s. As the golf ball, "DDH Tour Special" manufactured by SRI Sports Ltd., was used. Balls were hit at a position 20 mm away from a face center to a heel side, and a damage status of the shaft was examined every time 500 shots were hit. The upper limit for the test-hitting was set at 10000 shots. When there was no damage after 10000 shots, it was evaluated as "A"; and when there was damage before reaching 10000 shots, it was evaluated as "B."

It can be understood from the results shown in Tables 3 to 6 that the golf clubs according to the Examples can improve durability of the shaft and grip while extending flight distance of the ball by increasing head speed. In contrast, for example, with the golf clubs according to Comparative Example 8 and Comparative Example 14, it is thought that the durability of the shafts deteriorated since the head weights were large. In addition, with the golf clubs according to Comparative Example 12 and Comparative Example 18, it is thought that the durability of the shafts deteriorated since $L_G/L_S$ were high, and strengths of the front end parts were insufficient due to weight reduction on the front end side. Further, with the golf clubs according to Comparative Examples 19 to 31, it is thought that the ball flight distances were decreased since the head speeds and smash factors were reduced due to the club weight being heavy and the club being difficult to swing.

[Other Modifications]

It should be understood that the embodiments disclosed herein are merely illustrative and not restrictive in all aspects. The scope of the present invention is defined by the scope of the claims rather than by the meaning described above, and is intended to include meaning equivalent to the scope of the claims and all modifications within the scope.

Figure 6:
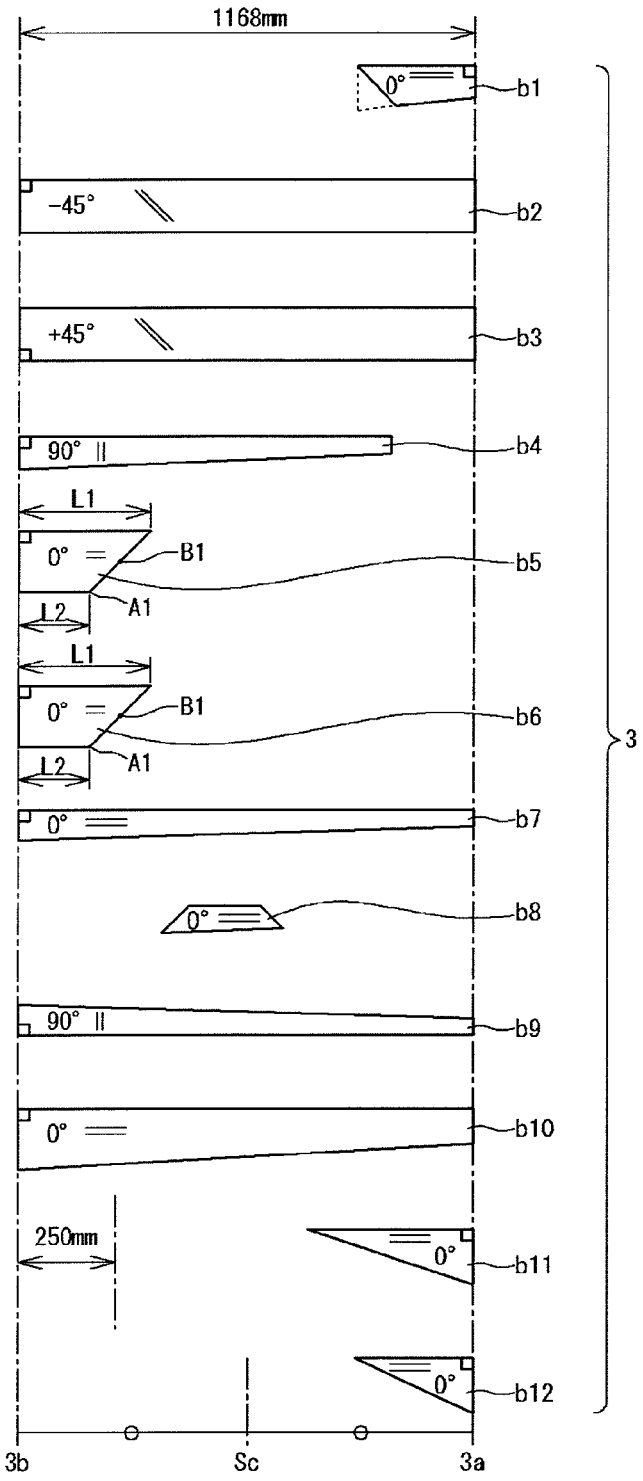
FIG. 6 is an expansion plan of a prepreg sheet included in a modification of the shaft of the present invention.

For example, in the above described embodiment, although a shaft having the expansion plan shown in FIG. 2 is adopted as the shaft of the golf club, the present invention is not limited thereto, and, for example, a shaft having an expansion plan shown in FIG. 6 may also be used. The shaft having the expansion plan shown in FIG. 6 includes twelve sheets of b1 to b12. Similar to FIG. 2, the expansion plan shown in FIG. 6 shows the sheets forming the shaft, sequentially from the inner side of the radial direction of the shaft; and winding is conducted sequentially from a sheet located on the upper side in the expansion plan. Further, in the expansion plan shown in FIG. 6, the right-left direction in the drawing coincides with the axial direction of the shaft, the right side in the drawing is the tip end 3*a* side of the shaft 3, and the left side in the drawing is the butt end 3*b* side of the shaft 3.

In a modification shown in FIG. 6, the sheet b1, the sheet b5, the sheet b6, the sheet b7, the sheet b8, the sheet b10, the sheet b11, and the sheet b12 are sheets forming the straight layers; the sheet b2 and the sheet b3 are sheets forming the bias layers; and the sheet b4 and the sheet b9 are sheets forming the hoop layers. As the sheets b1 to b12, for example, the following prepregs shown in Table 1 can be used.

Sheet b1: TR350C-125S

Sheets b2, b3: HRX350C-075S

Sheet b4: 805S-3

Sheets b5, b6: E1026A-09N

Sheets b7, b8: TR350C-100S

Sheet b9: 805S-3

Sheet b10: MR350C-100S

Sheets b11, b12: TR350C-100S

In the modification shown in FIG. 6, the major difference from that shown in FIG. 2 is arrangement of the sheet b4, which forms the partial hoop layer, between the sheets b5 and b6, which form the partial straight layers, and the sheets b2 and b3, which form the bias layers.

Figure 7:
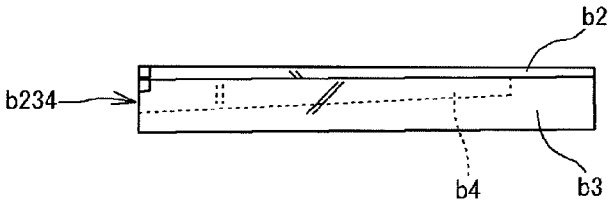
FIG. 7 is a plan view of a first merged sheet of the shaft shown in FIG. 6.
Figure 8:
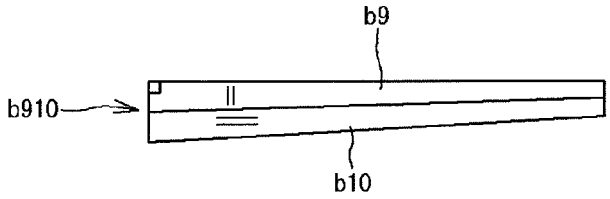
FIG. 8 is a plan view of a second merged sheet of the shaft shown in FIG. 6.

Also in the modification shown in FIG. 6, a merged sheet formed by attaching two or more sheets together is employed. In the modification shown in FIG. 6, two merged sheets shown in FIGS. 7 and 8 are employed. FIG. 7 shows a first merged sheet b234 formed by attaching the sheet b2, the sheet b3, and the sheet b4 together. In addition, FIG. 8 shows a second merged sheet b910 formed by attaching the sheet b9 and the sheet b10 together.

The procedure for manufacturing the first merged sheet b234 will be described below. A pre-merged sheet b34 is manufactured by attaching two sheets (bias sheet b3 and hoop sheet b4) together. When manufacturing the pre-merged sheet b34, the bias sheet b3 is turned over and attached to the hoop sheet b4. In the pre-merged sheet b34, the upper end of the sheet b4 matches the upper end of the sheet b3. Next, the pre-merged sheet b34 and the bias sheet b2 are attached together. The pre-merged sheet b34 and the bias sheet b2 are attached together in a state where they are misaligned from each other by half a wind.

In the merged sheet b234, the sheet b2 and the sheet b3 are misaligned from each other by half a wind. Thus, in the shaft after the winding, the circumferential direction position of the sheet b2 and the circumferential direction position of the sheet b3 are different. The angular difference here is preferably 180° (±15°).

As a result of using the merged sheet b234, the bias layer b2 and the bias layer b3 are misaligned from each other in the circumferential direction. With this misalignment, the positions of the ends of the bias layers are spread in the circumferential direction. As a result, it is possible to improve uniformity of the shaft in the circumferential direction. Further, in the merged sheet b234 in the present modification, the entirety of the hoop sheet b4 is sandwiched between the bias sheet b2 and the bias sheet b3. With this, it is possible to prevent inferior winding of the hoop sheet b4 in the winding step. By using the merged sheet b234, it is possible to improve accuracy of the winding. Here, inferior winding means disarray of fibers, generation of wrinkles, and deviation of fiber angle, etc.

Further, as shown in FIG. 8, in the second merged sheet b910, the upper end of the sheet b9 matches the upper end of the sheet b10. In addition, in the sheet b910, the entirety of the sheet b9 is pasted on the sheet b10. As a result, inferior winding of the sheet b9 is prevented in the winding step.

Also in the present modification, it is possible to adjust and bring the position of the center of gravity of the shaft close to the hand side by employing one or more of the previously described means of (A) to (H).

REFERENCE SIGNS LIST

1 wood-type golf club
2 head
3 shaft
3*a* tip end
3*b* butt end
4 grip
4*e* grip end
5 shaft hole
6 hosel
7 grip hole
G center of gravity of shaft
$L_G$ distance from the tip end of the shaft to the center of gravity of the shaft
$L_s$ shaft full length

What is claimed is:

1. A golf club having a head disposed at a front end of a shaft and a grip disposed at a back end of the shaft, wherein
a club weight is not larger than 290 g,
a ratio (head weight/club weight) of a head weight to the club weight is not lower than 0.67 but not higher than 0.72,
a grip weight is not smaller than 27 g but not larger than 45 g, and
when a distance from the front end of the shaft to a center of gravity of the shaft is $L_G$ and when a full length of the shaft is $L_S$, $0.54 \leq L_G/L_S \leq 0.65$ is satisfied,
wherein when a weight of a butt partial layer existing in a range from a butt end of the shaft to a point separated from the butt end by 250 mm is represented as Wa, and when a weight of the shaft in the range is represented as Wb, Wa/Wb is not lower than 0.4 but not higher than 0.7.

2. The golf club according to claim 1, wherein a shaft weight is not smaller than 30 g but not larger than 58 g.

3. The golf club according to claim 1, wherein the club weight is not smaller than 265 g but not larger than 290 g.

4. The golf club according to claim 1, wherein the shaft full length $L_S$ is not smaller than 105 cm but not larger than 120 cm.

5. The golf club according to claim 1, wherein the club weight is not smaller than 265 g.

6. The golf club according to claim 1, wherein the club weight is not larger than 284 g.

7. The golf club according to claim 1, a club length is not smaller than 42 inches but not larger than 46.5 inches.

8. The golf club according to claim 1, wherein the head weight is not smaller than 185 g but not larger than 210 g.

9. The golf club according to claim 1, wherein the ratio of the head weight to the club weight is not lower than 0.68 but not higher than 0.715.

10. The golf club according to claim 1, wherein the grip weight is not smaller than 28 g but not larger than 44 g.

11. The golf club according to claim 1, wherein a shaft weight is not smaller than 34 g but not larger than 53 g.

12. The golf club according to claim 1, wherein a shaft length is not smaller than 1070 mm but not larger than 1180 mm.

13. The golf club according to claim 1, wherein when a distance from the front end of the shaft to the center of gravity of the shaft is $L_G$ and when a full length of the shaft is $L_S$, $0.56 \leq L_G/L_S \leq 0.63$ is satisfied.

14. The golf club according to claim 1, wherein a fiber elastic modulus of the butt partial layer is not lower than 5 t/mm$^2$ but not higher than 20 t/mm$^2$.

15. The golf club according to claim 1, wherein a resin content of the butt partial layer is not lower than 20 mass % but not higher than 50 mass %.

16. The golf club according to claim 1, wherein a weight of a butt straight layer with respect to the shaft weight is not smaller than 5 mass % but not larger than 50 mass %.

17. The golf club according to claim 1, wherein a fiber elastic modulus of a butt straight layer is not lower than 5 t/mm$^2$ but not higher than 20 t/mm$^2$.

18. The golf club according to claim 1, wherein a resin content of a butt straight layer is not lower than 20 mass % but not higher than 50 mass %.

* * * * *